US009780450B2

(12) United States Patent
Nakano

(10) Patent No.: US 9,780,450 B2
(45) Date of Patent: Oct. 3, 2017

(54) ANTENNA DEVICE AND ELECTRONIC APPLIANCE

(71) Applicant: Murata Manufacturing Co., Ltd., Nagaokakyo-shi, Kyoto-fu (JP)

(72) Inventor: Shinichi Nakano, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 105 days.

(21) Appl. No.: 14/672,278

(22) Filed: Mar. 30, 2015

(65) Prior Publication Data

US 2015/0207223 A1 Jul. 23, 2015

Related U.S. Application Data

(63) Continuation of application No. PCT/JP2014/070007, filed on Jul. 30, 2014.

(30) Foreign Application Priority Data

Aug. 14, 2013 (JP) ..... 2013-168447

(51) Int. Cl.
*H01Q 7/06* (2006.01)
*H01Q 1/24* (2006.01)
*H01Q 13/10* (2006.01)

(52) U.S. Cl.
CPC ..... *H01Q 7/06* (2013.01); *H01Q 1/243* (2013.01); *H01Q 13/10* (2013.01)

(58) Field of Classification Search
CPC ..... G06K 7/10178; G06K 19/07794
See application file for complete search history.

(56) References Cited

U.S. PATENT DOCUMENTS

2014/0340273 A1 11/2014 Kato et al.
2015/0380827 A1* 12/2015 Tahtinen ..... H01F 38/14 343/702

FOREIGN PATENT DOCUMENTS

JP 2004-064780 A 2/2004
JP 4993045 B2 8/2012

OTHER PUBLICATIONS

Official Communication issued in International Patent Application No. PCT/JP2014/070007, mailed on Sep. 9, 2014.

* cited by examiner

*Primary Examiner* — Robert Karacsony
(74) *Attorney, Agent, or Firm* — Keating & Bennett, LLP

(57) ABSTRACT

An antenna device includes a feeder coil connected to a feeder circuit, a first conductor surface including a first slit that extends in a direction toward an outer edge and a second conductor surface including a second slit that extends in a direction toward an outer edge. The feeder coil is arranged at a position that is superposed with the first slit when viewed in plan, the feeder coil and the first conductor surface are magnetically coupled with each other, the first conductor surface and the second conductor surface are magnetically coupled with each other and the first slit and the second slit are arranged at positions so as to be partially superposed with each other when viewed in plan. At least a portion of the first slit is superposed with a portion of the second conductor surface other than the second slit when viewed in plan, and at least portion of the second slit is superposed with a portion of the first conductor surface other than the first slit when viewed in plan.

19 Claims, 13 Drawing Sheets

ANTENNA DEVICE AND ELECTRONIC APPLIANCE

BACKGROUND OF THE INVENTION

1. Field of the Invention

The present invention relates to antenna devices preferably for use in near field communication (NFC) systems and so forth and to electronic appliances equipped with such an antenna device.

2. Description of the Related Art

In mobile communication appliances such as cellular phone terminals and tablet PCs, mounting of communication circuits corresponding to HF band communication systems such as an NFC system has been progressing.

In addition, profile reduction has also been progressing in recent mobile communication appliances and it has become increasingly common to reinforce the strength of such appliances through "metallization" of the casing by, for example, performing a magnesium plating treatment on a resin casing or using a metal casing such as an aluminum body in order to deal with strength deficiencies caused by such profile reduction.

However, in an electronic appliance that includes a metal casing, there are problems in that it becomes impossible to perform communication with a communication partner or the communication range is markedly degraded since a built-in antenna coil is shielded by the metal.

Consequently, electronic appliances are known that include a metal casing having an opening and a slit formed therein as a radiating body such as disclosed in Japanese Patent No. 4993045.

Electronic appliances equipped with a communication circuit often include a wide planar conductor surface in order to electromagnetically shield high-frequency circuits and electrostatically shield flat panel displays, and also to stabilize a reference potential of a touch panel.

However, in electronic appliances equipped with a wide planar conductor surface inside the casing, the antenna coil inside the casing is shielded by the conductor surface. If an opening and a slit are formed in the conductor surface in order to avoid such shielding, the original shielding property and the stability of the electrical potential are degraded.

Furthermore, if the opening and the slit are at a position where they are visible from the outside, there may also be a restriction from the viewpoint of design.

SUMMARY OF THE INVENTION

Accordingly, preferred embodiments of the present invention provide an antenna device that secures both electrical characteristics such as a shielding property and stability of an electrical potential, and communication performance, and provide an electronic appliance equipped with the antenna device.

An antenna device according to a preferred embodiment of the present invention includes a feeder coil connected to a feeder circuit, a first conductor surface including a first slit that extends in a direction toward an outer edge and a second conductor surface including a second slit that extends in a direction toward an outer edge, the feeder coil being arranged at a position that is superposed with the first slit when viewed in plan, the feeder coil and the first conductor surface are magnetically coupled with each other, the first conductor surface and the second conductor surface are magnetically coupled with each other, the first slit and the second slit are partially superposed with each other when viewed in plan, at least a portion of the first slit is superposed with a portion of the second conductor surface other than the second slit when viewed in plan, and at least a portion of the second slit is superposed with a portion of the first conductor surface other than the first slit when viewed in plan.

With this structure, the first conductor surface and the second conductor surface define and act as a shield conductor and a reference potential conductor, and define and act as radiating elements. As a result, electrical characteristics such as a shield property and stability of an electrical potential, and communication performance are secured.

It is preferable that the first slit and the second slit each include a large-width portion and that the large-width portion of the first slit, the large-width portion of the second slit and the feeder coil are superposed with one another when viewed in plan. Thus, the degree of coupling between the first conductor surface, the second conductor surface and the feeder coil is high and high antenna radiation efficiency is obtained.

It is preferable that the first conductor surface and the second conductor surface be electrically (DC) conductive with each other. As a result, reduction of a shield property and stability of an electrical potential and so on are further reduced or prevented.

An electronic appliance according to a preferred embodiment of the present invention includes the antenna device having the above-described configuration and a flat panel display, the first conductor surface and the second conductor surface being arranged on a rear surface of the flat panel display. With this configuration, the conductor surfaces provided on the rear surface of the flat panel display are utilized as radiating elements.

An electronic appliance according to another preferred embodiment of the present invention includes the antenna device having the above-described configuration and a communication circuit connected to the antenna device.

With various preferred embodiments of the present invention, communication performance is secured while securing electrical characteristics such as a shield property and stability of an electrical potential.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
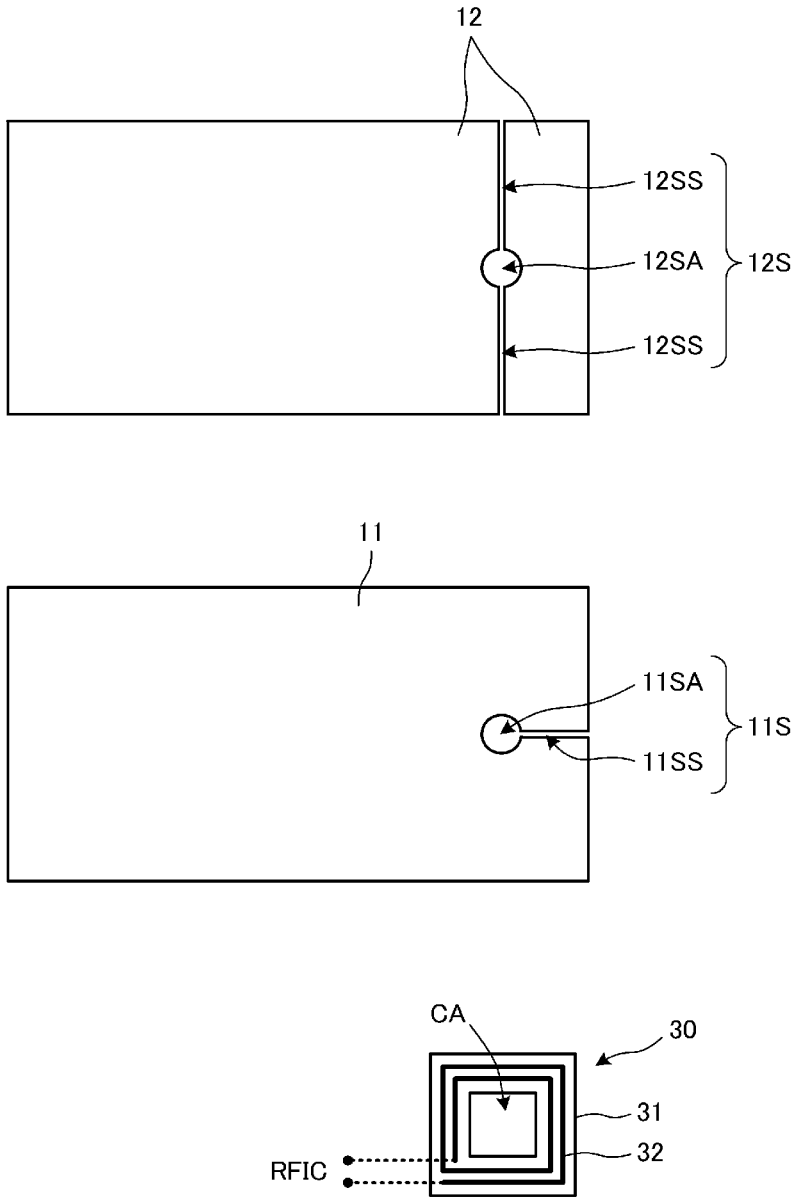
FIG. 1 is a plan view in which constituent elements of an antenna device of a first preferred embodiment are illustrated in an arrayed manner spaced apart from one another.

Hereafter, preferred embodiments of the present invention will be described by giving a number of specific examples while referring to the drawings. Like symbols denote like portions in the drawings. Each preferred embodiment is an illustrative example and elements and features of the configurations illustrated in different preferred embodiments can be substituted for one another or combined with each other.

First Preferred Embodiment

Figure 2A:
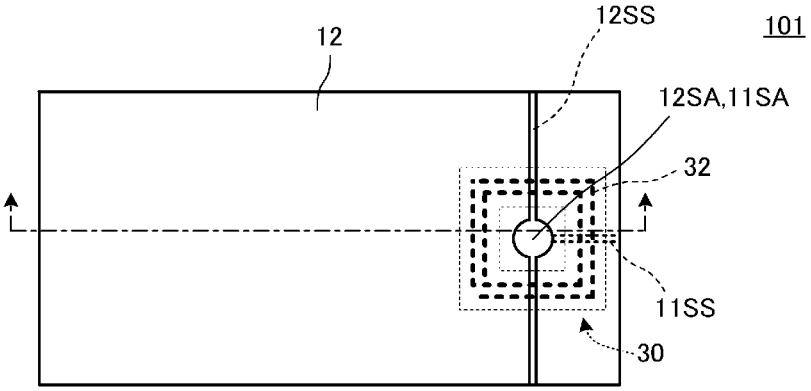
FIG. 2A is a plan view of an antenna device 101 of the first preferred embodiment and FIG. 2B is a sectional view of the antenna device 101.
Figure 2B:
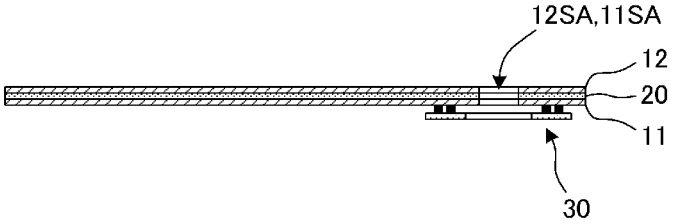

FIG. 1 is a plan view in which constituent elements of an antenna device of a first preferred embodiment of the present invention are illustrated in an arrayed manner spaced apart from one another. FIG. 2A is a plan view of this antenna device 101 and FIG. 2B is a sectional view of the antenna device 101.

The antenna device 101 includes a feeder coil 30, which is connected to a feeder circuit, a first conductor surface 11 and a second conductor surface 12. The feeder coil 30 includes a magnetic sheet 31 and a coil conductor 32. The coil conductor 32 is configured as a coil pattern on a flexible substrate, which is not illustrated. The flexible substrate is adhered to the magnetic sheet 31. An opening CA is provided in the center of the magnetic sheet 31 and the coil conductor 32 is configured so as to be wound around the opening CA in a spiral shape. That is, the opening CA is an opening in the magnetic sheet 31 and is a coil opening. An RFIC is connected to the two ends of the coil conductor 32.

The first conductor surface 11 preferably includes a rectangular or substantially rectangular metal plate and a first slit 11S that extends in a direction toward an outer edge is provided in the metal plate. The first slit 11S includes a slit portion 11SS and an opening portion 11SA having a shape resulting from an end portion of the slit portion 11SS (end portion on opposite side to outer edge side of first conductor surface 11) expanding into a circular or substantially circular shape. This opening portion 11SA corresponds to a "large-width portion" in various preferred embodiments of the present invention.

The second conductor surface 12 preferably includes a rectangular or substantially rectangular metal plate and a second slit 12S that extends in a direction toward an outer edge is provided in the metal plate. The second slit 12S includes a slit portion 12SS and an opening portion 12SA having a shape resulting from a central portion of the slit portion 12SS expanding into a circular or substantially circular shape. This opening portion 12SA corresponds to a "large-width portion" in various preferred embodiments of the present invention.

The outer shapes of the first conductor surface 11 and the second conductor surface 12 preferably are the same or substantially the same and the positions of the opening portions 11SA and 12SA are decided upon so that the opening portions 11SA and 12SA will be superposed with each other in a state where the first conductor surface 11 and the second conductor surface 12 are stacked one on top of the other.

Regarding the slit portion 11SS of the first slit 11S in the first conductor surface 11, the slit portion 11SS is superposed in plan view with a portion of the second conductor surface 12 other than the second slit 12S in a state where the first conductor surface 11 and the second conductor surface 12 are stacked one on top of the other.

In addition, regarding the slit portion 12SS of the second slit 12S in the second conductor surface 12, the slit portion 12SS is superposed in plan view with a portion of the first conductor surface 11 other than the first slit 11S in a state where the first conductor surface 11 and the second conductor surface 12 are stacked one on top of the other. In other words, only the opening portions 11SA and 12SA of the first slit 11S and the second slit 12S are superposed with each other.

As illustrated in FIGS. 2A and 2B, the first conductor surface 11 and the second conductor surface 12 are bonded to each other with an insulating adhesive layer 20. In this state, the slit portion 11SS is superposed with the second conductor surface 12 and the slit portion 12SS is superposed with the first conductor surface 11.

The coil conductor 32 of the feeder coil 30 is magnetically coupled with the first conductor surface 11 and the second conductor surface 12 is magnetically coupled with the first conductor surface 11. Thus, the second conductor surface defines and functions as a radiating element. This action of functioning as a radiating element will be described in detail later.

The first conductor surface 11 and the second conductor surface 12 define and function as a shield conductor and a reference potential conductor, and define and function as radiating elements. As a result, electrical characteristics such as a shield property and stability of an electrical potential, and communication performance are secured. In addition, it is difficult for either of the slit portions 11SS and 12SS to be seen from the outside. Furthermore, in the case where the first conductor surface 11 and the second conductor surface 12 double as structural members, the strength as structural members is secured since the formation positions of the slit portions in the conductor surfaces are different from each other.

Figure 3:
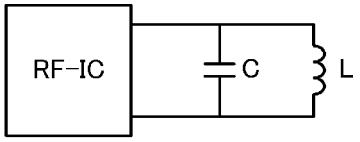
FIG. 3 illustrates the configuration of a feeder circuit that is connected to a feeder coil 30.

FIG. 3 illustrates the configuration of a feeder circuit that is connected to the feeder coil 30. The RF-IC in FIG. 3 is a communication circuit for NFC including a high-frequency integrated circuit. An inductor L is an inductance component of the feeder coil 30 and a capacitor C is a capacitance component of the feeder coil 30 and a capacitor defining a matching circuit.

Figure 4:
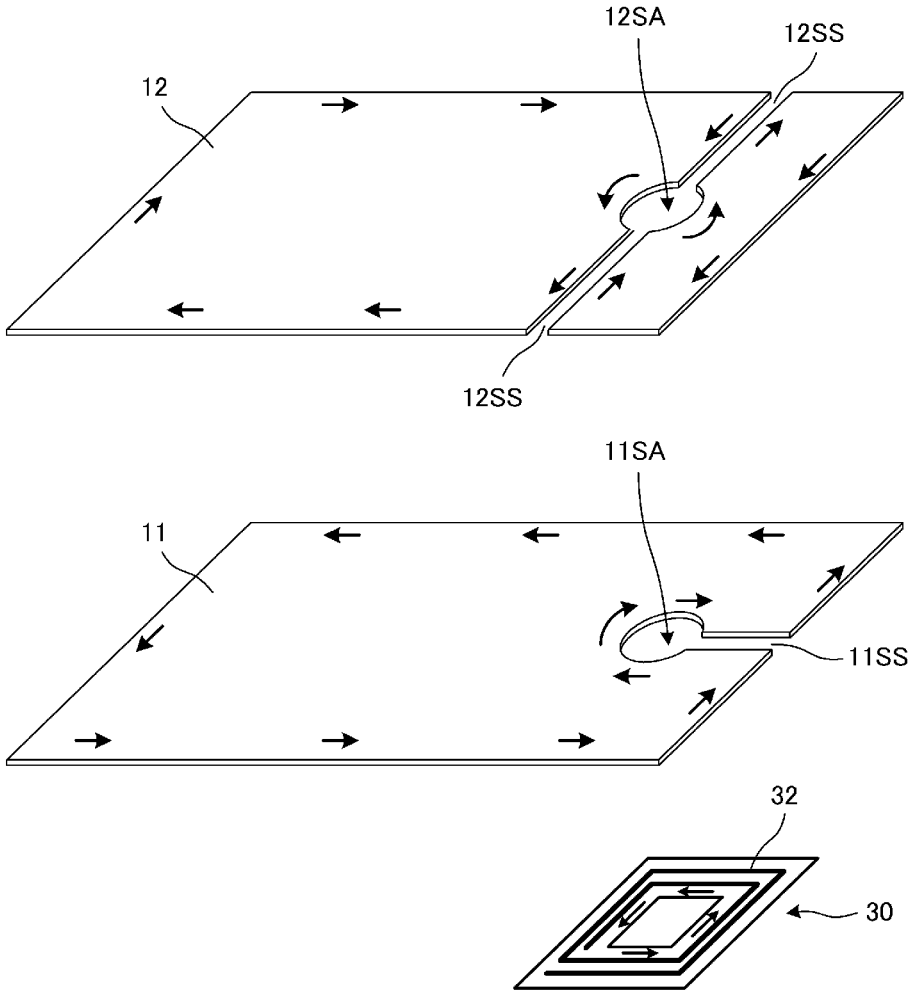
FIG. 4 is an exploded perspective view illustrating operation of the antenna device 101.

FIG. 4 is an exploded perspective view illustrating operation of the antenna device 101. When a current indicated by the arrows in FIG. 4 flows in the coil conductor 32 of the feeder coil 30, an induced current flows as indicated by the arrows around the opening portion 11SA of the first conductor surface 11. This current flows along the periphery of the first conductor surface 11 via the slit portion 11SS. A current is induced in the second conductor surface 12 by the current flowing in the first conductor surface 11. That is, an induced current as indicated by the arrows flows around the opening portion 12SA and along the periphery of the second conductor surface 12. This second conductor surface defines and functions as a radiating element and couples with the antenna of a communication partner such as a reader/writer. Thus, a current flows along the periphery of the second conductor surface, the second conductor surface defines and functions as a radiating element and the communication range is not greatly decreased.

Figure 5A:
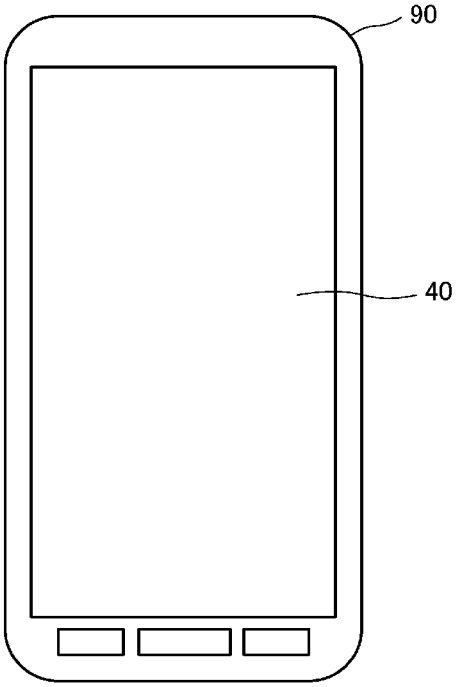
FIG. 5A is a top surface view of an electronic appliance equipped with the antenna device and FIG. 5B is a bottom surface view of the same.
Figure 5B:
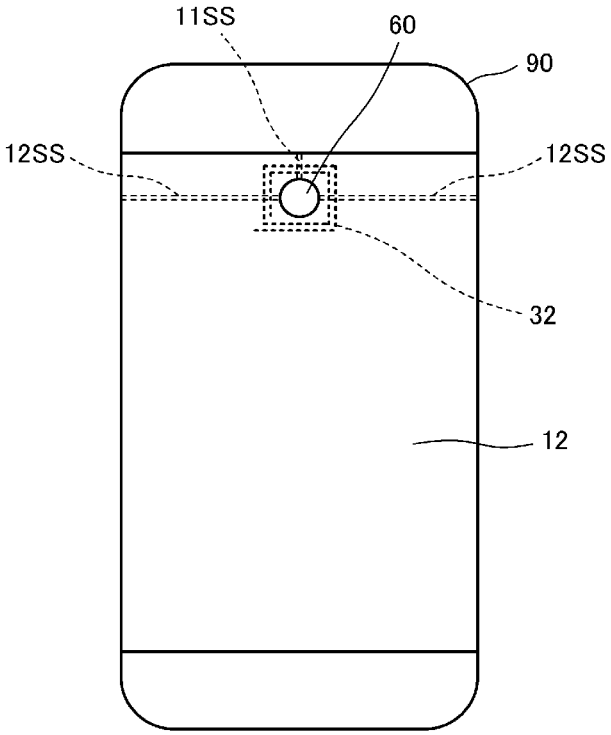

FIG. 5A is a top surface view of an electronic appliance equipped with the antenna device and FIG. 5B is a bottom surface view of the same. This electronic appliance is a mobile communication appliance such as a cellular phone terminal or a tablet PC, for example. A display 40 is provided on a top surface side of the appliance. A portion of the lower-surface side of a casing 90 is a metal portion. This metal portion includes the first conductor surface 11 and the second conductor surface 12. A camera module 60 is arranged such that a lens and so forth of the camera module 60 are exposed at a position where the opening portions 11SA and 12SA of the first conductor surface 11 and the second conductor surface 12 are superposed with each other.

The bottom surface of the electronic appliance illustrated in FIG. 5 is held over the antenna of a reader/writer, and as a result, the second conductor surface 12 defines and functions as a radiating element and communication is performed.

Second Preferred Embodiment

Figure 6:
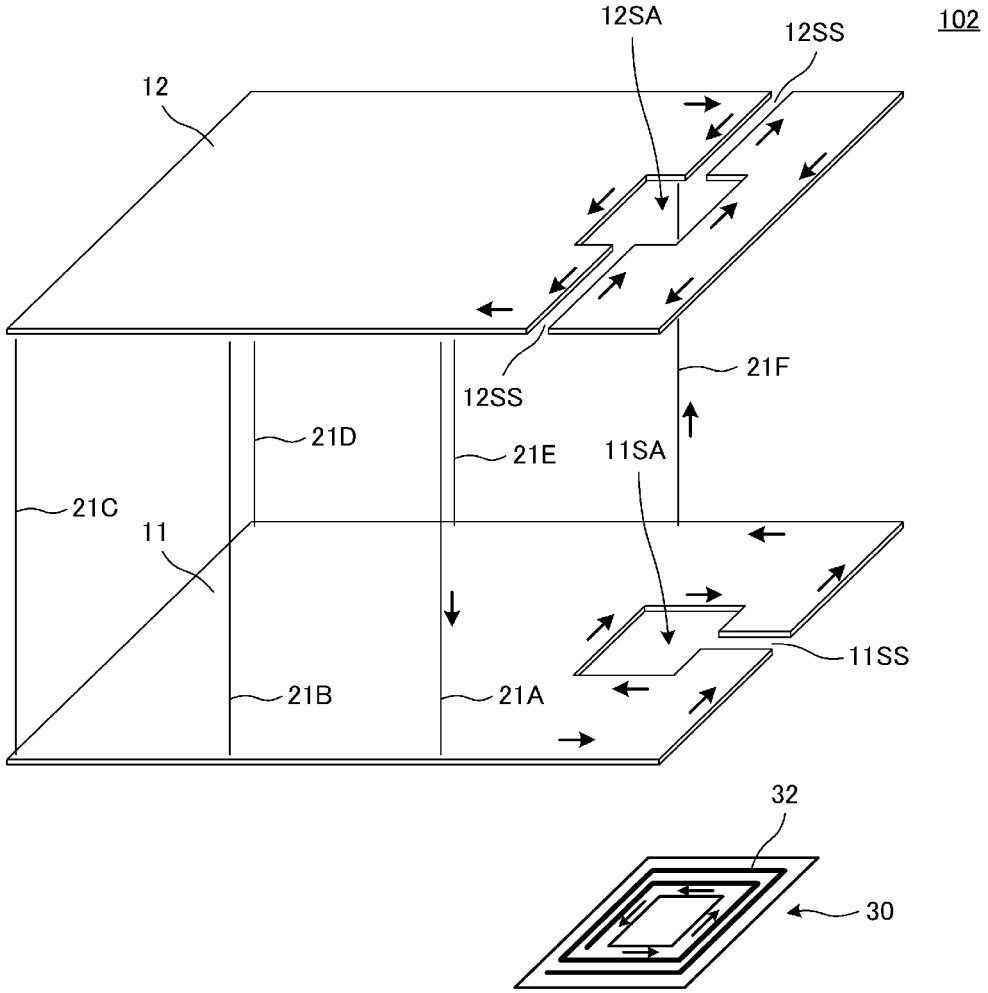
FIG. 6 is an exploded perspective view of an antenna device 102 of a second preferred embodiment of the present invention.

FIG. 6 is an exploded perspective view of an antenna device 102 of a second preferred embodiment of the present invention. This antenna device differs from the antenna device of the first preferred embodiment illustrated in FIG. 4 in that the first conductor surface 11 and the second conductor surface 12 are electrically (DC) conductive with each other through conductor surface connection conductors 21A, 21B, 21C, 21D, 21E and 21F at a plurality of positions. In addition, in this preferred embodiment, the opening portion 11SA provided in the first conductor surface 11 and the opening portion 12SA formed in the second conductor surface 12 have a rectangular or substantially rectangular shape in accordance with the shape of the coil conductor 32 of the feeder coil 30.

The first conductor surface 11 and the second conductor surface 12 are made to be conductive with each other via the conductor surface connection conductors 21A to 21F at a plurality of positions, such that the electrical potentials of the first conductor surface 11 and the second conductor surface 12 are stabilized at a fixed electrical potential over a wide range. Consequently, in the case where the first conductor surface 11 and the second conductor surface 12 are used as ground electrodes, a ground potential is made to be more stable in the electronic appliance and operation of the various circuits is made to be more stable.

The conductor surface connection conductors 21A to 21F are arranged at positions that are spaced apart from the positions at which the slits of the first conductor surface 11 and the second conductor surface 12 (opening portions 11SA, 12SA and slit portions 11SS, 12SS) are provided. Specifically, the conductor surface connection conductors are provided at positions on the two sides between which the slit is interposed outside of an area in which the current density of the induced current flowing in the second conductor surface 12 is between its maximum value and about 80% of its maximum value, for example, or at a position on one of the two sides between which the slit is interposed inside the area. That is, the two conductor surface connection conductors 21A and 21F that are closest to the slit are arranged outside the area in which the current density of the induced current flowing in the second conductor surface 12 is between its maximum value and about 80% of its maximum value, for example. In the case where conductor surface connection conductors are arranged inside the area, it is preferable that they be provided on at positions on one of the two sides between which the slit is interposed (such that the slit is not interposed between two conductor surface connection conductors).

When a current indicated by the arrows in FIG. 6 flows in the coil conductor 32 of the feeder coil 30, an induced current flows as indicated by the arrows around the opening portion 11SA of the first conductor surface 11. This current flows along the periphery of the first conductor surface 11 via the slit portion 11SS, particularly along the portion of the periphery close to the formation position of the slit (opening portions 11SA, 12SA and slit portions 11SS, 12SS). A current is induced in the second conductor surface 12 by the current flowing in the first conductor surface 11. The currents flowing along the peripheries of the first conductor surface 11 and the second conductor surface 12 mainly flow through the conductor surface connection conductors 21A and 21F. This second conductor surface defines and functions as a radiating element and couples with the antenna of a communication partner such as a reader/writer.

Third Preferred Embodiment

Figure 7:
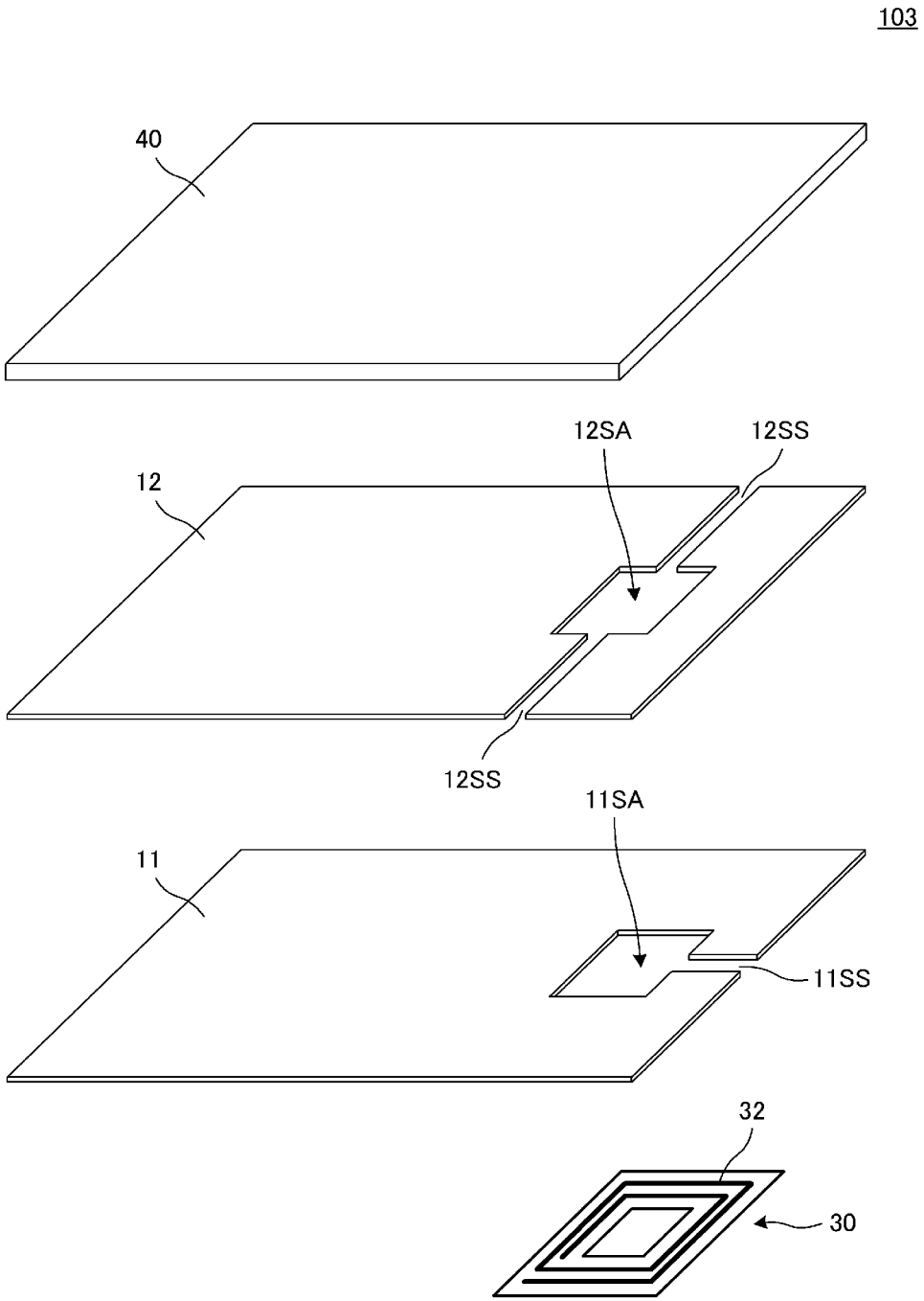
FIG. 7 is an exploded perspective view of an antenna device 103 of a third preferred embodiment of the present invention.

FIG. 7 is an exploded perspective view of an antenna device 103 of a third preferred embodiment of the present invention. The antenna device 103 includes a display 40 formed of a liquid crystal display panel equipped with a touch panel and a display surface of this display 40 acts as a communication surface. This display 40 corresponds to a "flat panel display" of various preferred embodiments of the present invention. The basic configurations of the feeder coil 30, the first conductor surface 11 and the second conductor surface 12 preferably are the same as those described in the first and second preferred embodiments. The second conductor surface 12 and the first conductor surface 11 are adhered to a rear surface of the display 40 and these elements are integrated with each other. The antenna device 103 is provided of this multilayer body and the feeder coil 30.

Transparent electrodes (ITO) are provided in the liquid crystal display panel and the touch panel of the display 40 but these transparent electrodes are not conductive films that are continuous over the whole surface and therefore radiation from the second conductor surface 12 is not blocked. Thus, communication is performed in a state where the display surface of the display 40 is held over the antenna of the communication partner.

Fourth Preferred Embodiment

Figure 8:
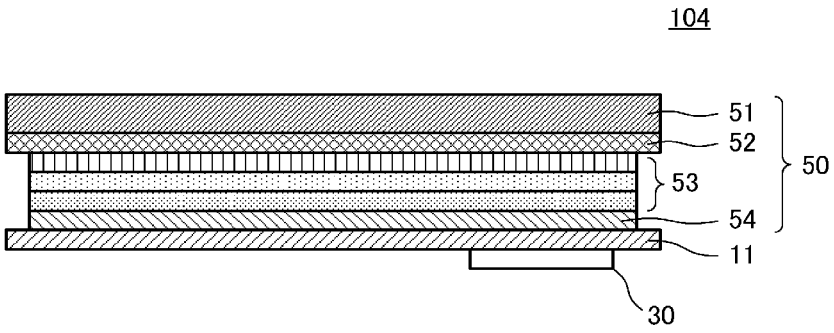
FIG. 8 is a sectional view of an antenna device 104 of a fourth preferred embodiment of the present invention.

FIG. 8 is a sectional view of an antenna device 104 of a fourth preferred embodiment of the present invention. Here, the thickness direction is drawn in an exaggerated manner in order to make the layer structure clearer. The antenna device 104 includes a display 50 preferably including an organic EL display panel and a display surface of this display 50 defines and functions as a communication surface. This display 50 corresponds to a "flat panel display" of various preferred embodiments of the present invention.

The display 50 is a multilayer structure including a glass substrate 51, an anode 52, an organic EL layer 53 and a cathode 54. The organic EL layer 53 includes a hole transport layer, a light-emitting layer, an electron transport layer and so forth.

A first conductor surface 11 is adhered to a rear surface of the display 50. The shape of the first conductor surface 11 is preferably the same as that of the first conductor surface 11 illustrated in FIG. 7 in the third preferred embodiment. The cathode 54 corresponds to a "second conductor surface" of various preferred embodiments of the present invention. The shape of the cathode 54 is the same as that of the second conductor surface 12 illustrated in FIG. 7 in the third preferred embodiment. The cathode 54 preferably is a Mg/Al electrode film, for example, and a slit pattern is preferably formed therein when forming the cathode 54 on the organic EL layer 53.

The feeder coil 30 is arranged close to a position that is superposed with the opening portions of the slits provided in the cathode 54 and the first conductor surface 11 when viewed in plan.

The anode 52 is a transparent electrode (ITO), for example, and is configured so as not to be continuous over the whole surface (for example, line-shaped transparent electrodes are arranged at a pitch of several tens of μm). Consequently, a large eddy current is not generated in the anode 52 and radiation from the cathode 54 is not blocked. Thus, communication is performed in a state where the display surface of the display 50 is held over the antenna of the communication partner.

Fifth Preferred Embodiment

Figure 9:
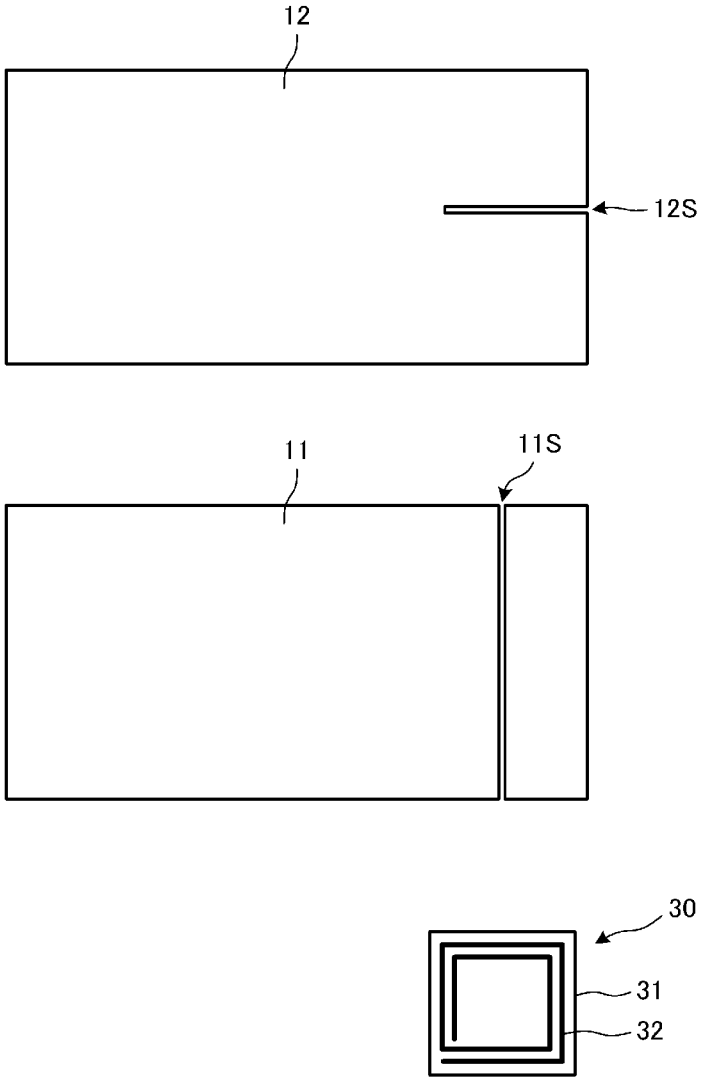
FIG. 9 is a plan view in which constituent elements of an antenna device of a fifth preferred embodiment of the present invention are illustrated in an arrayed manner spaced apart from one another.
Figure 10A:
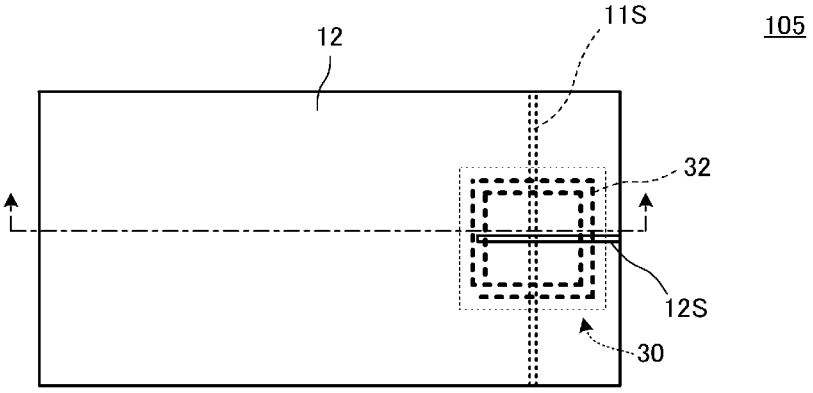
FIG. 10A is a plan view of an antenna device 105 of the fifth preferred embodiment of the present invention and FIG. 10B is a sectional view of the antenna device 105.

FIG. 9 is a plan view in which constituent elements of an antenna device of a fifth preferred embodiment of the present invention are illustrated in an arrayed manner spaced apart from one another. FIG. 10A is a plan view of this antenna device 105 and FIG. 10B is a sectional view of the antenna device 105.

The antenna device includes a feeder coil 30, which is connected to a feeder circuit, a first conductor surface 11 and a second conductor surface 12. In this example, slits 11S and 12S of the first conductor surface 11 and the second conductor surface 12 do not have an opening portion (large-width portion) and preferably include just a slit portion having a constant width. The feeder coil 30 includes a magnetic sheet 31 and a coil conductor 32, the coil conductor 32 being wound in a rectangular or substantially rectangular spiral shape on the magnetic sheet. The feeder coil 30 is different than that illustrated in FIG. 1 in that an opening is not provided in the center of the magnetic sheet 31. An RFIC is connected to the two ends of the coil conductor 32. The feeder coil 30 is arranged so that a coil opening thereof is superposed with a position at which the slit 11S and the slit 12S cross each other.

Figure 10B:
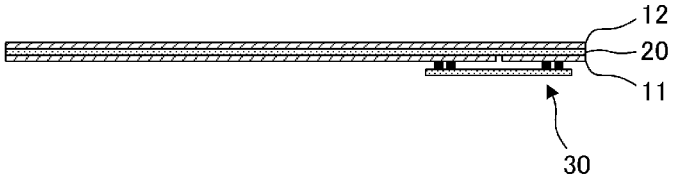

As illustrated in FIGS. 10A and 10B, the first conductor surface 11 and the second conductor surface 12 are bonded to each other with an insulating adhesive layer 20. In this state, the slit portion 11SS is superposed with the second conductor surface 12 and the slit portion 12SS is superposed with the first conductor surface 11.

Thus, there does not need to be an opening portion in the slits 11S and 12S of the first conductor surface 11 and the second conductor surface 12. In particular, a simpler pattern for the slit in the second conductor surface 12 enables there to be a greater degree of freedom from the viewpoint of design.

Sixth Preferred Embodiment

Figure 11:
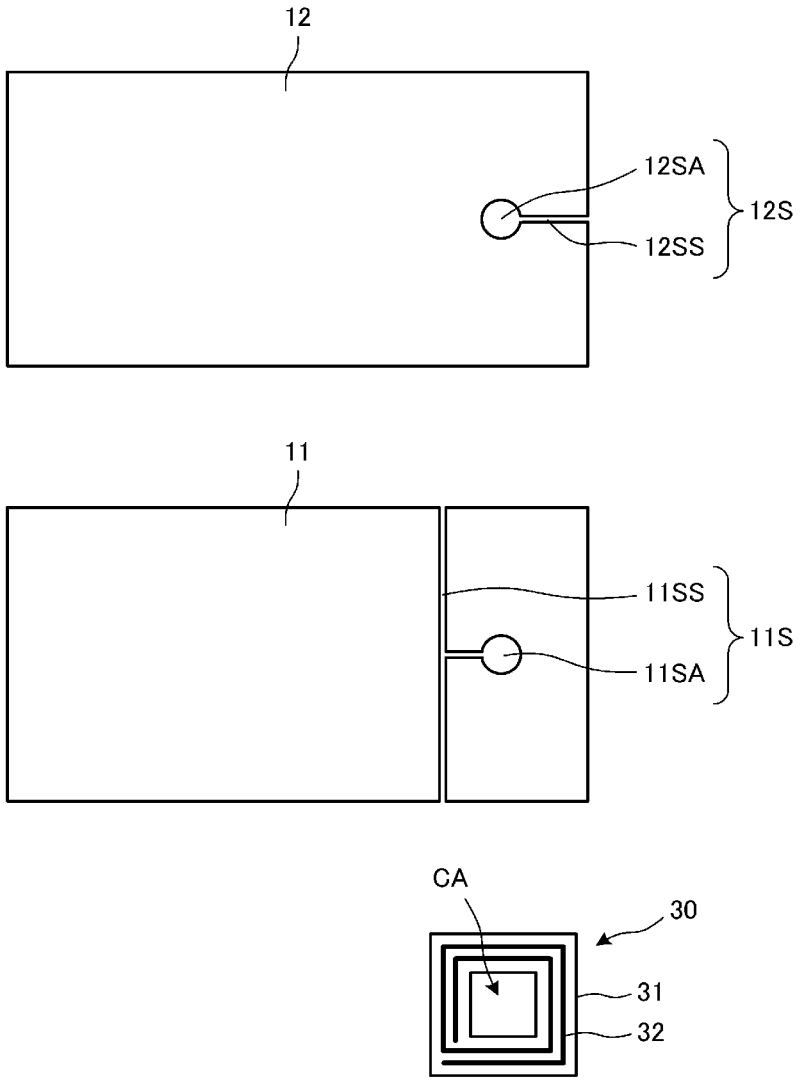
FIG. 11 is a plan view in which constituent elements of an antenna device of a sixth preferred embodiment of the present invention are illustrated in an arrayed manner spaced apart from one another.

FIG. 11 is a plan view in which constituent elements of an antenna device of a sixth preferred embodiment of the present invention are illustrated in an arrayed manner spaced apart from one another. The antenna device includes a feeder coil 30, which is connected to a feeder circuit, a first conductor surface 11 and a second conductor surface 12. In this example, a slit 11S of the first conductor surface 11 preferably includes an opening portion 11SA and a slit portion 11SS, but the slit portion 11SS preferably has a T-shape that branches midway therealong. The feeder coil 30 is arranged such that an opening CA thereof is superposed with the opening portions 11SA and 12SA when viewed in plan.

Seventh Preferred Embodiment

Figure 12:
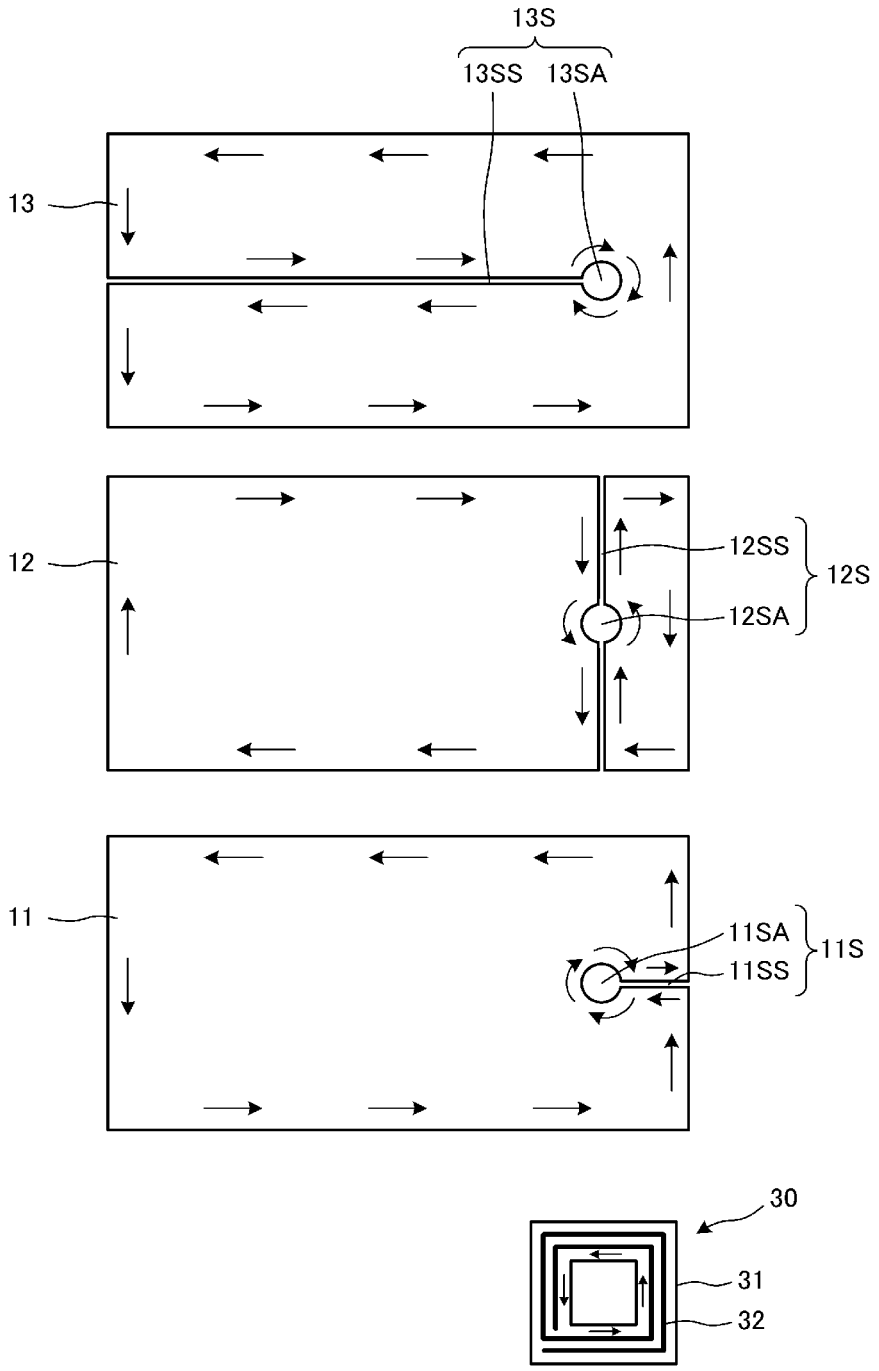
FIG. 12 is a plan view in which constituent elements of an antenna device of a seventh preferred embodiment of the present invention are illustrated in an arrayed manner spaced apart from one another.
Figure 13A:
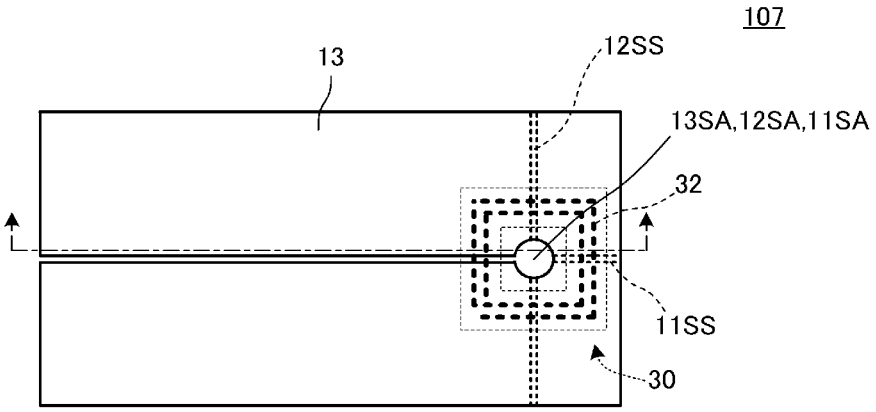
FIG. 13A is a plan view of an antenna device 107 of the seventh preferred embodiment of the present invention and FIG. 13B is a sectional view of the antenna device 107.
Figure 13B:
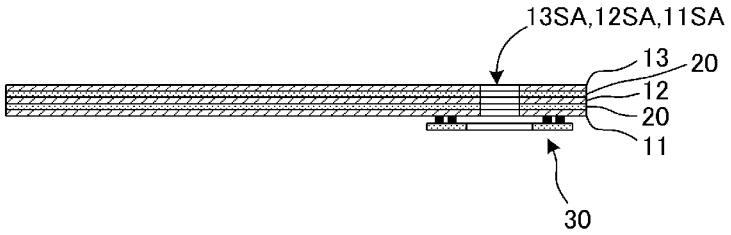

FIG. 12 is a plan view in which constituent elements of an antenna device of a seventh preferred embodiment of the present invention are illustrated in an arrayed manner spaced apart from one another. FIG. 13A is a plan view of this antenna device 107 and FIG. 13B is a sectional view of the antenna device 107.

The antenna device 107 includes a feeder coil 30, which is connected to a feeder circuit, and a plurality of conductive surfaces. In this example, a first conductor surface 11, a second conductor surface 12 and a third conductor surface 13 are provided. The configuration of the feeder coil 30 is preferably the same as that described in the first preferred embodiment and so forth.

The first conductor surface 11 preferably includes a rectangular or substantially rectangular metal plate and a first slit 11S is provided in the metal plate. The first slit 11S preferably includes a slit portion 11SS and an opening portion 11SA having a shape resulting from an end portion of the slit portion 11SS expanding into a circular or substantially circular shape. The second conductor surface 12 preferably is defined by a rectangular or substantially rectangular metal plate and a second slit 12S is provided in the metal plate. The second slit 12S preferably includes a slit portion 12SS and an opening portion 12SA having a shape resulting from a central portion of the slit portion 12SS expanding into a circular or substantially circular shape. Similarly, the third conductor surface 13 is preferably defined by a rectangular or substantially rectangular metal plate and a third slit 13S is provided in the metal plate. The third slit 13S preferably includes a slit portion 13SS and an opening portion 13SA having a shape resulting from an end portion of the slit portion 13SS expanding into a circular or substantially circular shape.

Regarding the slit portion 11SS of the first conductor surface 11, the slit portion 11SS is superposed in plan view with a portion of the second conductor surface 12 other than the second slit 12S and with a portion of the third conductor surface 13 other than the third slit 13S in a state where the first conductor surface 11, the second conductor surface 12 and the third conductor surface 13 are stacked on top of one another. Regarding the slit portion 12SS of the second conductor surface 12 and the slit portion 13SS of the third conductor surface 13, similarly, these slit portions 12SS and 13SS are superposed with portions of the other conductor surfaces other than the slits.

As illustrated in FIGS. 13A and 13B, the first conductor surface 11 and the second conductor surface 12 are bonded to each other with an insulating adhesive layer 20. Similarly, the second conductor surface 12 and the third conductor surface 13 are bonded to each other with an insulating adhesive layer 20.

When a current indicated by the arrows in FIG. 12 flows in the coil conductor 32 of the feeder coil 30, an induced current flows as indicated by the arrows around the opening portion 11SA of the first conductor surface 11. This current flows along the periphery of the first conductor surface 11 via the slit portion 11SS. An induced current indicated by the arrows flows around the opening portion 12SA and along the periphery of the second conductor surface 12 due to the current flowing in the first conductor surface 11. An induced current indicated by the arrows flows around the opening portion 13SA and along the periphery of the third conductor surface 13 due to the current flowing in the second conductor surface 12.

As a result of the current flowing in the third conductor surface 13 which defines the surface (outer surface) in this way, the third conductor surface 13 defines and functions as a radiating element and is coupled with the antenna of a communication partner such as a reader/writer.

Thus, there may be three conductor surfaces (three layers).

Eighth Preferred Embodiment

Figure 14:
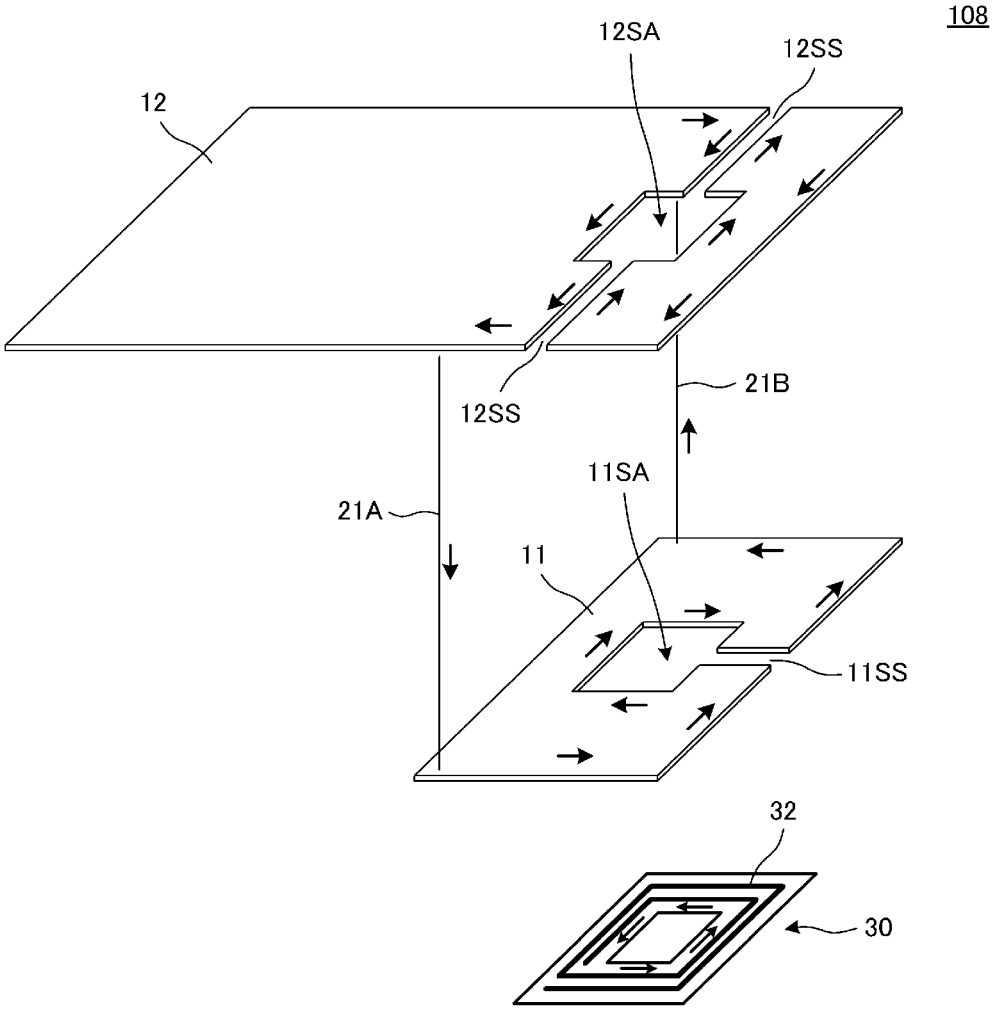
FIG. 14 is an exploded perspective view of an antenna device 108 of an eighth preferred embodiment of the present invention.

FIG. 14 is an exploded perspective view of an antenna device 108 of an eighth preferred embodiment of the present invention. This antenna device 108 includes a feeder coil 30, which is connected to a feeder circuit, a first conductor surface 11 and a second conductor surface 12. The first conductor surface 11 has a smaller size than the second conductor surface 12. A slit including an opening portion 11SA and a slit portion 11SS is provided in the first conductor surface 11. An opening portion 12SA is provided in the second conductor surface 12. The opening portion 12SA of the second conductor surface 12 is superposed with the opening portion 11SA of the first conductor surface 11. A slit portion 12SS of the second conductor surface 12 is superposed with the first conductor surface 11 when viewed in plan. The first conductor surface 11 and the second conductor surface 12 are conductive with each other via conductor surface connection conductors 21A and 21B.

Thus, even though the first conductor surface 11 and the second conductor surface 12 have different sizes, an antenna device is provided.

Ninth Preferred Embodiment

Figure 15:
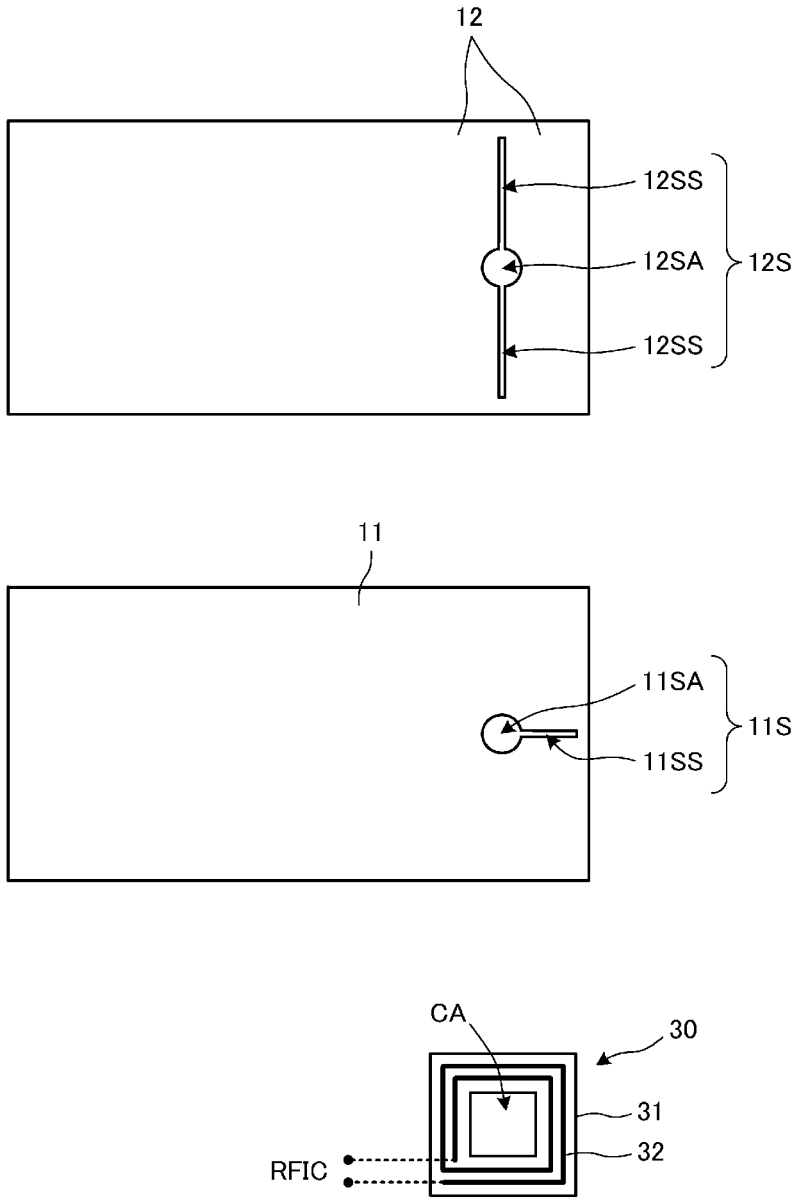
FIG. 15 is an exploded perspective view of an antenna device of a ninth preferred embodiment of the present invention.

FIG. 15 is a plan view in which constituent elements of an antenna device of a ninth preferred embodiment of the present invention are illustrated in an arrayed manner spaced apart from one another. Different to the antenna device illustrated in FIG. 1 in the first preferred embodiment, leading ends of slit portions 11SS and 12SS do not reach the outer edges of the conductor surfaces. Thus, even though the leading ends of the slit portions are not open, the longer the slit portions become, the more the strength of a current that circumvents the leading ends of these slits is reduced and the more the strength of the current flowing along the outer edges of the conductor surfaces is increased. Consequently, the antenna device operates as an antenna device with a similar action to the action described in each of the above preferred embodiments.

Other Preferred Embodiments

In the above-described preferred embodiments, examples were illustrated in which a slit portion provided in a conductor surface preferably has a linear shape, for example, but a slit portion may instead have a curved shape. In addition, a portion of the slit portion may have a curved shape, for example.

In addition, in the above-described preferred embodiments, examples were described in which a conductor surface was preferably flat, for example, but a conductor surface may instead be a curved surface. In addition, a portion of the conductor surface may be a curved surface.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna device comprising:

a feeder coil connected to a feeder circuit;

a first conductor surface including a first slit that extends in a direction toward an outer edge; and a second conductor surface including a second slit that extends in a direction toward an outer edge; wherein the feeder coil is arranged at a position that is superposed with the first slit when viewed in plan;

the feeder coil and the first conductor surface are magnetically coupled with each other;

the first conductor surface and the second conductor surface are magnetically coupled with each other;

the first conductor surface is disposed between the second conductor surface and the feeder coil such that the second conductor surface and the feeder coil are disposed on opposite sides of the first conductor surface;

the first slit and the second slit are partially superposed with each other when viewed in plan;

at least a portion of the first slit is superposed with a portion of the second conductor surface other than the second slit when viewed in plan; and at least a portion of the second slit is superposed with a part of the first conductor surface other than the first slit when viewed in plan.

2. The antenna device according to claim 1, wherein the first slit and the second slit each include a large-width portion, and the large-width portion of the first slit, the large-width portion of the second slit and the feeder coil are superposed with one another when viewed in plan.

3. The antenna device according to claim 1, wherein the first conductor surface and the second conductor surface are electrically conductive with each other.

4. The antenna device according to claim 1, wherein the feeder coil includes a magnetic sheet and a coil conductor.

5. The antenna device according to claim 4, wherein the magnetic sheet includes an opening around which the coil conductor is wound in a spiral shape.

6. The antenna device according to claim 1, wherein the first slit includes a slit portion that expands into a circular or substantially circular shape.

7. The antenna device according to claim 1, wherein the second slit includes a slit portion that expands into a circular or substantially circular shape.

8. The antenna device according to claim 1, wherein the first conductor surface and the second conductor surface define a shield conductor and a reference potential conductor and define radiating elements.

9. The antenna device according to claim 1, wherein the feeder circuit is an RF-IC defining a communication circuit for near field communication.

10. The antenna device according to claim 3, further comprising conductor surface connection conductors arranged to electrically connect the first conductor surface and the second conductor surface.

11. The antenna device according to claim 10, wherein the conductor surface connection conductors are spaced from the slits of the first conductor surface and the second conductor surface.

12. An electronic appliance comprising:

a flat panel display; and the antenna device according to claim 1; wherein the first conductor surface and the second conductor surface are arranged on a rear surface of the flat panel display.

13. The electronic appliance according to claim 12, wherein the electronic appliance is one of a cellular phone and a tablet computer.

14. The electronic appliance according to claim 12, wherein the flat panel display is a liquid crystal display panel defining a touch panel.

15. An electronic appliance comprising:

the antenna device according to claim 1; and a communication circuit connected to the antenna device.

16. The electronic appliance according to claim 15, wherein the electronic appliance is one of a cellular phone and a tablet computer.

17. The electronic appliance according to claim 15, further comprising a casing, wherein the first conductor surface and the second conductor surface define a surface of the casing.

18. The electronic appliance according to claim 15, further comprising a camera including a lens exposed at a location where opening portions of the first conductor surface and the second conductor surface are superposed with one another.

19. The antenna device according to claim 1, wherein the feeder coil, the first conductor surface, and the second conductor surface are arranged in order such that the second conductor surface functions as a radiating element and couples with an antenna of a communication partner.

* * * * *